US008800674B2

(12) United States Patent
Hartmann et al.

(10) Patent No.: US 8,800,674 B2
(45) Date of Patent: Aug. 12, 2014

(54) APPARATUS FOR RELEASING A FLUID TO THE ATMOSPHERE

(76) Inventors: Marc Hartmann, Chippendale (AU); Derrick Yap, Glenwood (AU)

( * ) Notice: Subject to any disclaimer, the term of this patent is extended or adjusted under 35 U.S.C. 154(b) by 606 days.

(21) Appl. No.: 12/595,952

(22) PCT Filed: Apr. 15, 2008

(86) PCT No.: PCT/AU2008/000529

§ 371 (c)(1),
(2), (4) Date: Oct. 14, 2009

(87) PCT Pub. No.: WO2008/124884

PCT Pub. Date: Oct. 23, 2008

(65) Prior Publication Data

US 2010/0126740 A1 May 27, 2010

(30) Foreign Application Priority Data

Apr. 17, 2007 (AU) ..... 2007902017

(51) Int. Cl.
*A62C 8/00* (2006.01)

(52) U.S. Cl.
USPC ..... 169/36; 102/204

(58) Field of Classification Search
USPC ..... 169/36; 102/369, 396, 204, 205, 272
See application file for complete search history.

(56) References Cited

U.S. PATENT DOCUMENTS

| | | | | |
|---|---|---|---|---|
| 1,903,348 | A * | 4/1933 | Anderson | 102/369 |
| 2,164,797 | A * | 7/1939 | Birkigt | 102/205 |
| 2,665,768 | A * | 1/1954 | Talbot | 169/36 |
| 2,703,527 | A * | 3/1955 | Hansen | 102/365 |
| 3,661,083 | A * | 5/1972 | Weimholt | 102/369 |
| 3,688,702 | A * | 9/1972 | Prior et al. | 102/204 |
| 4,672,897 | A * | 6/1987 | Betts | 102/513 |
| 6,318,473 | B1 | 11/2001 | Bartley et al. | |
| 6,546,875 | B2 * | 4/2003 | Vaughn et al. | 102/507 |

FOREIGN PATENT DOCUMENTS

| | | |
|---|---|---|
| AU | 719062 | 11/1998 |
| SU | 1712245 A1 | 2/1992 |
| WO | 2006/089977 A1 | 8/2006 |

OTHER PUBLICATIONS

International Search Report for PCT/AU2008/000529, mailed Jul. 21, 2008, 2 pgs.
International Preliminary Report on Patentability for PCT/AU2008/000529, completed May 1, 2009, 3 pgs.

* cited by examiner

*Primary Examiner* — Len Tran
*Assistant Examiner* — Viet Le
(74) *Attorney, Agent, or Firm* — K&L Gates LLP; Christine C. Vito; Pei Wu

(57) ABSTRACT

An apparatus (10) for releasing a fluid to the atmosphere comprises a housing (12) for the fluid. The housing can comprise a biodegradable polymer, or a polymer that has been adapted to biodegrade. The polymer can also comprise a component that is reflective to infrared radiation so as to prevent melting of the housing polymer during immersion in or while in proximity to flame. The apparatus further comprises a mechanism (30, 32, 42, 50, 56, 58) for causing the fluid to be released to the atmosphere from the housing. The mechanism can be housed in a second housing (14) that is detachably mounted to the first housing to define a housing unit. Further, a restraint mechanism (34) can be provided for regulating when the fluid is to be released from the housing to the atmosphere. The restraint mechanism can be deactivated once a certain force of apparatus impact with a surface has been reached.

26 Claims, 5 Drawing Sheets

APPARATUS FOR RELEASING A FLUID TO THE ATMOSPHERE

CROSS REFERENCE TO RELATED APPLICATIONS

This application is a national phase application under 35 U.S.C. §371 of International Patent Application No. PCT/AU2008/000529, filed Apr. 15, 2008, which claims priority to and the benefit of Australian Patent Application No. 2007902017, filed Apr. 17, 2007, the entire disclosures of each of which are incorporated by reference herein.

TECHNICAL FIELD

Disclosed is an improved apparatus for releasing a fluid to the atmosphere, typically by dispersing the fluid from a height above or at a surface (e.g. the ground).

The fluid can, for example, be of a type that extinguishes fires (e.g. water) or can be a chemical for release such as a herbicide, defoliant, pesticide, insecticide etc. The apparatus can atomize the fluid in the vicinity of e.g. a fire, crop etc.

BACKGROUND ART

Fire extinguisher devices that are dropped from a height onto a fire front are known. For example, WO 2004/03347 discloses a fire extinguisher that can be dropped from a helicopter and that comprises a container for extinguishing fluid and a blasting charge for rupturing the container and dispersing the extinguishing fluid. RU 2146544 discloses an aerial bomb that can also be dropped from a helicopter and which explodes at the fire front to deliver a fire-fighting substance to the fire.

A reference herein to a prior art document is not an admission that the document forms a part of the common general knowledge of a person of ordinary skill in the art in Australia or in any other country.

SUMMARY OF THE DISCLOSURE

In a first aspect there is provided an apparatus for releasing a fluid to the atmosphere, the apparatus comprising:

a housing for the fluid;

a mechanism for causing the fluid to be released to the atmosphere from the housing;

wherein the housing comprises a biodegradable polymer, or a polymer that has been adapted to biodegrade.

The employment of a biodegradable polymer (or a polymer adapted to biodegrade) in the housing enables the apparatus to be used in the open environment (e.g. in the fighting of bushfires) without itself representing a pollutant. Typically the bulk if not all components of the apparatus are adapted to biodegrade.

The polymer that is adapted to biodegrade may comprise an additive that promotes biodegradation and is itself biodegradable. The polymer can comprise a polyolefin such as polyethylene or polypropylene, and the additive can be in the form of a filler such as an inorganic carbonate, a synthetic carbonate, nepheline syenite, talc, magnesium hydroxide, aluminium trihydrate, diatomaceous earth, mica, natural or synthetic silicas and calcined clays or mixtures thereof. The additive may also be a metal carboxylate, inclusive of a large number of metals, such as cerium, cobalt, iron, and magnesium, an aliphatic poly hydroxy-carboxyl acid and/or calcium oxide.

In a second aspect there is provided an apparatus for releasing a fluid to the atmosphere, the apparatus comprising:

a polymer housing for the fluid;

a mechanism for causing an explosion to rupture the housing whereby the fluid is released to the atmosphere from the housing;

wherein the polymer comprises a component that is reflective to infrared radiation so as to prevent melting of the housing polymer during immersion in or whilst in proximity to flame.

Such flame may be generated by the explosion or it can be present in the local environ (e.g. during a bushfire). The component can thus preserve the plastic (e.g. during deployment and to allow for subsequent biodegradation or clean-up).

The component can coat or be incorporated into the polymer. For example, metallic coatings, layers and films can be applied to the polymer that are reflective to infrared radiation, such as metallic coatings, layers and films of e.g. zinc or aluminium, or a coating incorporating copper phthalocyanine.

The term "incorporated into" in relation to the component is intended to include component dyes or pigments in the polymer that are reflective to infrared radiation such as copper phthalocyanine dye, or titanium dioxide (rutile), red iron oxide and thin leafing aluminium flake pigments. Fire retardant paints and polymer additives can also be employed that reflect the thermal IR radiation emitted by fire. Such additives can reflect adverse electromagnetic energy and slow the spread of fire. The term also includes layers of polymer films whereby one of the layers (e.g. the in-use outer layer) is particularly reflective or scattering to infrared radiation.

The component is particularly suitable to be employed with the polymer adapted to biodegrade of the first aspect, whereby that polymer can be protected against melting by the component, thus enhancing or maintaining its capacity to later biodegrade.

In a third aspect there is provided an apparatus for releasing a fluid to the atmosphere, the apparatus comprising:

a housing for the fluid, the housing comprising an element that extends inwardly and within confines of the housing at a position adjacent to where the housing is adapted to impact at a surface; and a mechanism for causing rupture of the housing whereby the fluid is released to the atmosphere from the housing, the mechanism being activated to effect the rupturing by an inwards movement of the element caused by the housing impacting at the surface.

By configuring the element to extend inwardly within the confines of the housing an optimal profile of the housing can be preserved, and yet the element can still activate the mechanism. The optimal profile can be an aerodynamic profile (such as an aerodynamic leading "nose" of the apparatus).

In one form the mechanism comprises an explosive device which can be positioned within the apparatus whereby, at surface impact, the element moves towards the device to cause it to detonate and thus explode. The resultant explosion can then cause the housing to rupture and release the fluid. For example, the element can be piston-like and the housing can be elongate and comprise a nose and an opposing tail. The element can then extend inwardly from the nose, with an explosive charge being positioned adjacent to a free end of the element.

In one form the mechanism can take the form of an adiabatic fuse. In this regard, an enclosed gas cavity can be located between the element free end and the explosive charge, the gas cavity being adapted, upon impact thereon by the element free end, to release gas (e.g. air) under pressure into the explosive charge and thereby detonate the charge. In this regard, the explosive charge can comprise a first explosive material that is detonatable by the pressurised gas, and a second explosive material that surrounds the first explosive material and that is adapted to deflagrate when the first explosive material detonates.

In an alternative form the mechanism can take the form of a percussion fuse. In this regard, at impact the element can be forced against a percussion cap which in turn detonates the explosive device.

In a fourth aspect there is provided an apparatus for releasing a fluid to the atmosphere, the apparatus comprising:

a first housing for the fluid;

a second housing detachably mountable to the first housing to define a housing unit, the second housing being adapted for causing the fluid to be released to the atmosphere from the housing unit.

The detachable mounting of the first and second housings allows each to be manufactured separately (including fluid filling in the first housing), and stored and transported separately. It also allows the apparatus to be assembled on or close to site. This can also improve safety and handling of the apparatus.

The first housing for the fluid can be elongate, and one end of the first housing can comprise a generally flat portion so as to enable the first housing to separately stand on a surface. This can allow for easy fluid filling and storage. Further, an opposing end of the first housing can be openable to enable the fluid to be introduced therein.

The second housing may also incorporate the element of the third aspect.

The apparatus of the fourth aspect can otherwise be as defined in the first to third aspects. In this regard, the explosive device can be enclosed by the second housing.

In a fifth aspect there is provided an apparatus for releasing a fluid to the atmosphere, the apparatus comprising:

a housing for the fluid; and a restraint mechanism adapted for regulating when the fluid is to be released from the housing to the atmosphere, whereby the restraint mechanism is deactivated once a certain force of apparatus impact with a surface has been reached.

The restraint mechanism can thus allow for certain apparatus impact with a surface (i.e. to accommodate inadvertent apparatus dropping from a low height, such as may occur during transportation or installation).

In one form the housing comprises an element positioned adjacent to a location where the housing is adapted to impact at the surface such that the element is caused to be urged inwardly of the apparatus to effect the fluid release, and the restraint mechanism further comprises a member for restricting element movement until the certain force of apparatus impact with the surface is reached.

The element may have a piston-like form and may be adapted at surface impact to be urged inwardly towards an explosive charge positioned within the apparatus to detonate the same. The resultant explosion can then cause the housing to rupture and release the fluid.

The member can be ring-like to surround the piston-like element and only to allow its passage therethrough and towards the explosive charge when the apparatus impact with the surface produces the certain force. In this regard, the movement of the element through the member at the certain force can be enabled only by the member deforming or breaking.

In one example, the certain force may be reached only above e.g. a certain apparatus deployment (or drop) height of say 20 meters.

The apparatus of the fifth aspect can otherwise be as defined in the first to fourth aspects.

In a sixth aspect there is provided an apparatus for releasing a fluid to the atmosphere, the apparatus comprising:

an elongate housing for the fluid, the housing being adapted to spin about a longitudinal axis thereof as it falls through the atmosphere; and a mechanism for causing the fluid to be released to the atmosphere from the housing.

The spinning of the housing about its longitudinal axis as it falls through the atmosphere can enhance the capacity of the apparatus to be directed towards a target, and can also enhance (or ensure) surface impact at e.g. a nose of the housing. In this regard, the housing can comprise a nose and an opposing tail, and the adaptation of the housing to spin can comprise a device that is associated with the tail to induce the spinning about the housing's longitudinal axis.

In one form the device can comprise an end cap having a narrower forward end mountable to the tail, and a wider trailing end. The device can further comprise one or more recessed passageways in its outer surface moving from its forward to trailing ends, and through each of which air flows as the housing falls through the atmosphere so as to induce the spinning about the housing's longitudinal axis. For example, in relation to the longitudinal axis, the one or more passageways can each have a curve moving from the device's forward to trailing ends so as to induce the spinning.

The apparatus of the sixth aspect can otherwise be as defined in the first to fifth aspects.

Usually the housing's centre of gravity lies towards the nose, relative to the tail, such that the apparatus falls through the atmosphere nose first.

The mechanism for causing the fluid to be released to the atmosphere from the housing is typically adapted to cause the fluid to atomize at release. In this regard, the mechanism can be adapted to cause an explosion internally of the apparatus that in turn causes both housing rupture and the fluid atomization at release.

The housing can be provided with rupture lines or points that are located to provide a pre-weakened structure to the housing, thus facilitating mechanism release of fluid to the atmosphere (i.e. by facilitating housing rupture). The rupture lines or points can also allow the housing to rupture in a predictable fashion and increase the likelihood that the dispersal/atomization of the fluid will follow a predictable or predetermined pattern.

The device that is mounted to the housing tail can close a fluid opening to the housing when so mounted. The rupture lines/points in the housing may then be adapted such that a force/pressure required to cause them to fail is less than that required to force the device off its mounting to the tail.

The fluid can be of a type that extinguishes fires (e.g. water, or other fire retardant liquid or powder) or can be a chemical for release such as a herbicide, defoliant, pesticide, insecticide etc. The term "fluid" is thus to be interpreted broadly to include liquids, flowable solids such as powders and slurries, and also atomizable solids.

The apparatus may optimally have the form of a bomb (or missile) so that it can be targeted in use.

BRIEF DESCRIPTION OF THE DRAWINGS

Notwithstanding any other forms which may fall within the scope of the fluid releasing apparatus as defined in the Summary, a number of specific apparatus embodiments will now be described, by way of example only, with reference to the accompanying drawings in which.

DETAILED DESCRIPTION OF SPECIFIC EMBODIMENTS

Referring now to the Figures, an apparatus for releasing a fluid to the atmosphere is shown in the form of a bomb (or missile) 10. The bomb is shaped to optimise its targeting in use. The bomb comprises a housing for both the fluid and an explosive device, with the housing assuming the form of a two-part casing that comprises a first elongate casing portion 12 for the fluid, and a second shorter casing cap (or nose cone) 14 that is detachably mountable to an end of the first casing portion to define a casing unit. When so mounted, the second casing portion 14 surrounds and encloses both the explosive device and a mechanism for activating the explosive device. The explosive device is such as to cause the fluid to be released to the atmosphere from the casing unit, as described below.

The first elongate casing portion 12 can be provided with rupture lines or points that are located to provide a pre-weakened structure to the casing, thus facilitating release of fluid to the atmosphere (i.e. by facilitating casing rupture during explosion of the explosive device). The rupture lines or points can run parallel to the bomb's longitudinal axis. The rupture lines or points can also allow the bomb to rupture in a predictable fashion (i.e. to increase the likelihood that the dispersal/atomization of the fluid will follow a predictable or predetermined pattern).

The detachable mounting of the first and second casing portions 12,14 allows each to be manufactured separately, and allows for easy fluid filling in the first casing (as described below). It also allows for each casing portion to be stored and transported separately, and for bomb assembly to occur at or close to a usage site. This can improve both the safety and handling of the bomb.

Figure 3:
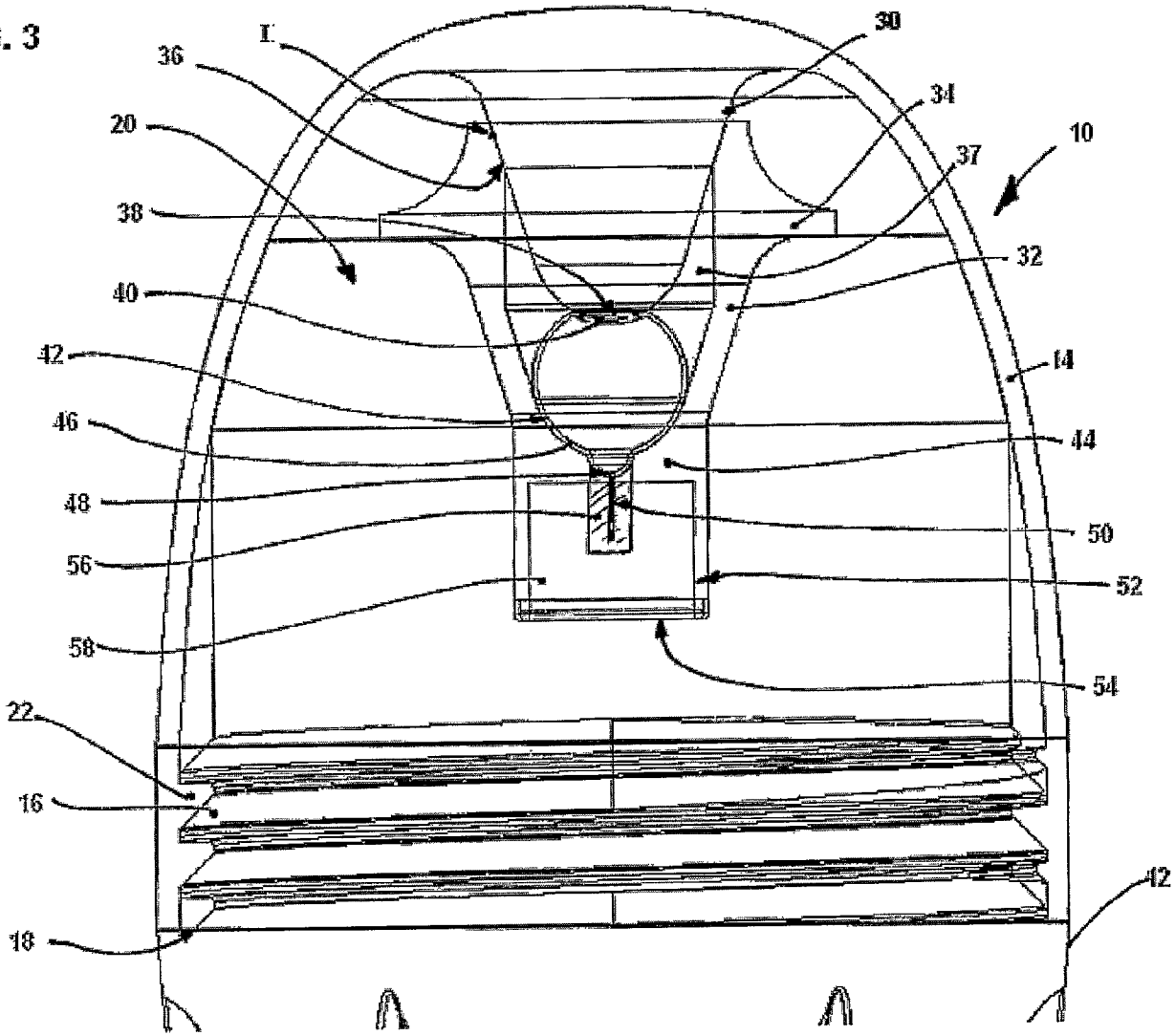
FIG. 3 shows in side view a cross-sectional detail of the apparatus nose of FIG. 2.

As best shown in FIG. 3, the detachable mounting of the first and second casing portions is facilitated by an external threaded region 16 that is located in a rebate 18 that is inset from a closed (explosives) end 20 of the first casing portion 12. An internal threaded region 22 located at and within an open end of the second casing portion 14 then mates with the external threaded region 16 such that, when fully mounted, a substantial proportion (or length) of the second casing portion surrounds the closed (explosives) end 20 of the first casing portion 12. This provides for increased hoop strength at this part of the bomb, so that the explosive device preferentially ruptures the bomb away from this part (i.e. preferentially ruptures at a remainder of the first casing portion 12).

The detachable mounting of the first and second casing portions can be facilitated by another detachable mechanism such as a bayonet coupling, snap- or interference-fitting arrangement etc.

The closed (explosives) end 20 of the first casing portion 12 is generally flat to enable the casing portion to separately stand on a surface. This can allow for easy fluid filling at an opposite tail end 24 of the first casing portion 12 (i.e. before a tail cap 26 is screw mounted thereto, as described below). For example, filling can take place at a standard bottling plant operation. This generally flat end can also facilitate storage of the un-filled or filled casing portion 12 (i.e. when separated from the second casing portion 14).

Figure 2:
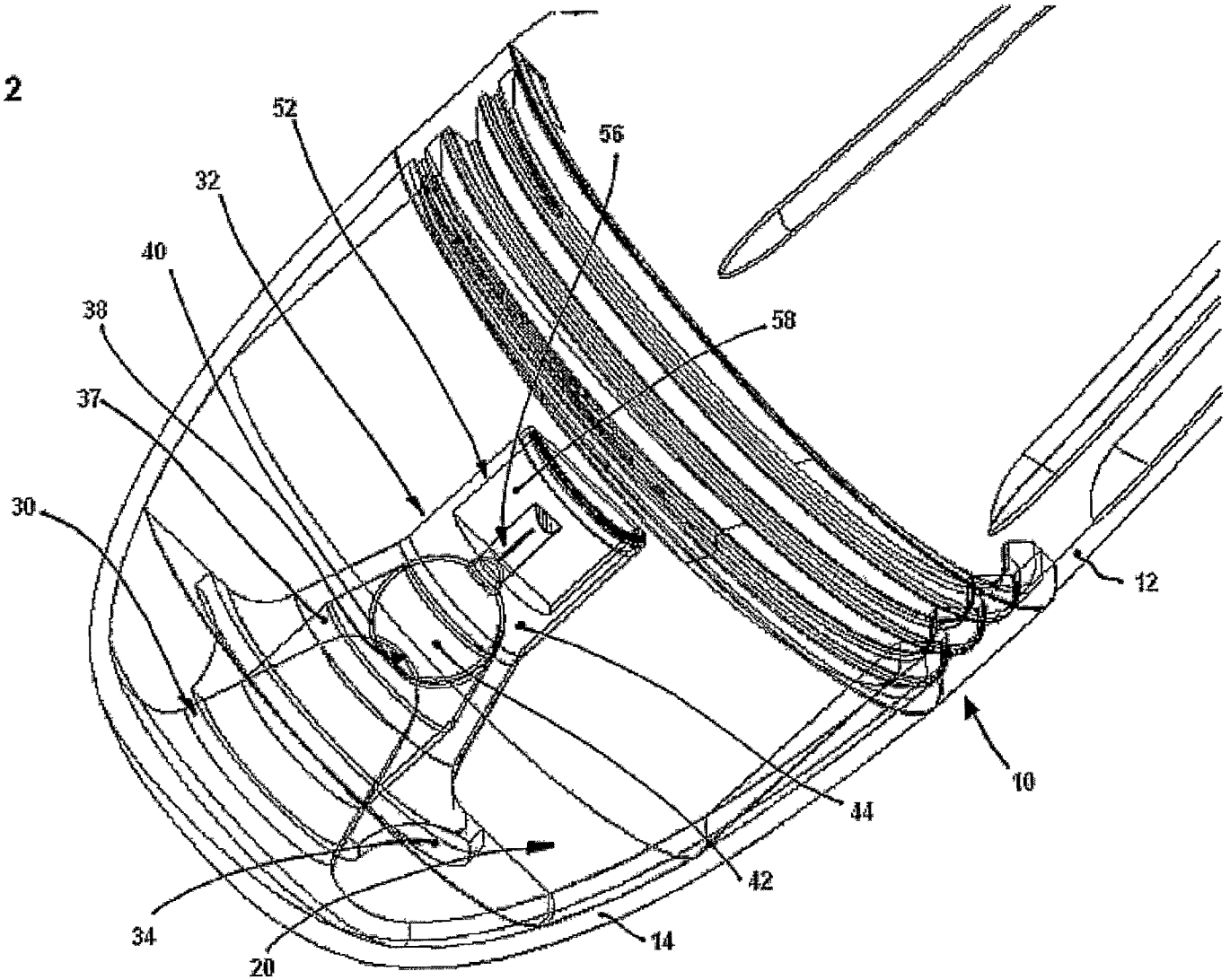
FIG. 2 shows a detail of a nose of the apparatus cross-section of FIG. 1.

Again, as best shown in FIGS. 2 & 3, the second casing portion 14 can comprise an element in the form of a piston 30 that is formed integrally with the casing to extend internally thereof (i.e. within the confines of the bomb). The piston is located on an inside of the casing portion 14 that is adjacent to where the bomb is adapted to impact at a surface. This has the result of forcing the piston inwardly of the bomb at impact, as described below. Also, by forming the piston to lie within the confines of the second casing portion 14 an optimal (e.g. curved aerodynamic) profile can be provided at a nose of the bomb, and yet the piston can still activate the bomb.

When the first and second casing portions 12,14 are mounted together the piston 30 extends into the closed (explosives) end 20 of the first casing portion 12. In this regard, the piston interacts with a restraint mechanism that restrains piston movement to prevent inadvertent fluid release from the bomb to the atmosphere. Further, the restraint mechanism is deactivated only once a certain force of bomb impact with a surface has been reached. The restraint mechanism can thus allow the bomb to accommodate inadvertent bomb dropping from a low height (e.g. during transportation or installation).

A tube-like cartridge 32 having a ring-like flared end 34 is mounted into the closed (explosives) end 20 of the first casing portion 12 as shown. The flared end 34 surrounds a passage into the cartridge 32. The restraint mechanism can be defined as an inner tapered surface 36 of the ring-like flared end 34 that is adapted to surround and interfere with the piston 30 when the first and second casing portions 12,14 are mounted together.

Also, when the first and second casing portions 12,14 are mounted together, the piston 30 can actually hold the cartridge 32 in place in the closed end 20 (i.e. so that the cartridge does not require separate fixing to the closed end).

In this regard, the taper on the inner surface 36 interacts with an opposite taper on the piston (see arrow I in FIG. 3) and this configuration thus only allows further advancement of the piston into the passage when bomb impact with a surface (e.g. the ground) produces a certain (i.e. sufficiently high) reactive force. In fact, the movement of the piston through the ring-like flared end 34 can occur only by the flared end deforming or breaking. This deformation or breakage is facilitated by a series of windows 37 formed through and around the wall of cartridge 32.

The ring-like flared end 34 can thus be provided with a breaking strain (tensile failure) such that it will not deform or break if the bomb is dropped or impacted moderately in handling or transport, but will do so if subjected to the forces associated with a drop from an aircraft. In one example, a safety threshold can be imposed whereby the reactive force is reached only when the bomb is dropped above a height of say 20 meters.

As the piston is caused to move further into the passage of cartridge 32 its free end 38 moves against a deformable external wall 40 of an enclosed gas reservoir 42 located at a base 44 of the cartridge passage. An opposing wall 46 of the gas reservoir 42 comprises a needle-like valve 48 that extends into a thin capillary conduit 50, itself extending through the base 44. In one embodiment the volumetric dimension ratio of the gas reservoir 42 to the conduit 50 is not less than 8/1, to achieve a high gas pressure in conduit 50.

Located within cartridge 32 on an opposite side of the base 44 is an explosive device 52. The explosive device is sealed in this end of the cartridge by a biodegradable and water-soluble plastic plug 54 (e.g. formed of a starch-based plastic). The explosive device 52 comprises a first explosive material 56 into which the capillary conduit 50 continues to extend, with the material 56 being of a type that is detonatable by the pressurised gas. A second explosive material 58 (i.e. propellant charge) surrounds the first explosive material and is adapted to deflagrate when the first explosive material detonates.

Thus, at surface impact, the sudden movement of the piston end 38 against reservoir wall 40 forces gas under pressure from the reservoir, through the conduit 50 and into the material 56 to detonate the same. The resultant explosion of material 58 blows off the plug 54 and is propagated into the fluid in first casing portion 12 to cause it at least to rupture and release the fluid from the bomb. This rupturing can be facilitated by rupture lines or point as described below. The arrangement depicted provides a reliable form of an adiabatic fuse.

In an alternative embodiment, at surface impact, the piston 30 can be forced against a percussion cap located in the cartridge 32 adjacent to an explosive charge, to in turn detonate the explosive charge. This latter arrangement thus provides a form of percussion fuse.

In either case, the explosive device is typically adapted to cause fluid held in the first casing portion 12 to atomize at release, as the casing ruptures. This atomization of the fluid increases its surface area, making it more effective as a fire extinguishing agent, or as a herbicide, defoliant, pesticide, insecticide etc.

By locating the explosive device etc such that is surrounded by the second casing portion 14 (i.e. by the nose cone) the bomb's centre of gravity lies towards the nose, relative to the tail, such that the bomb then falls through the atmosphere nose first (i.e. centre of mass forward of the bomb's aerodynamic centre).

Figure 4:
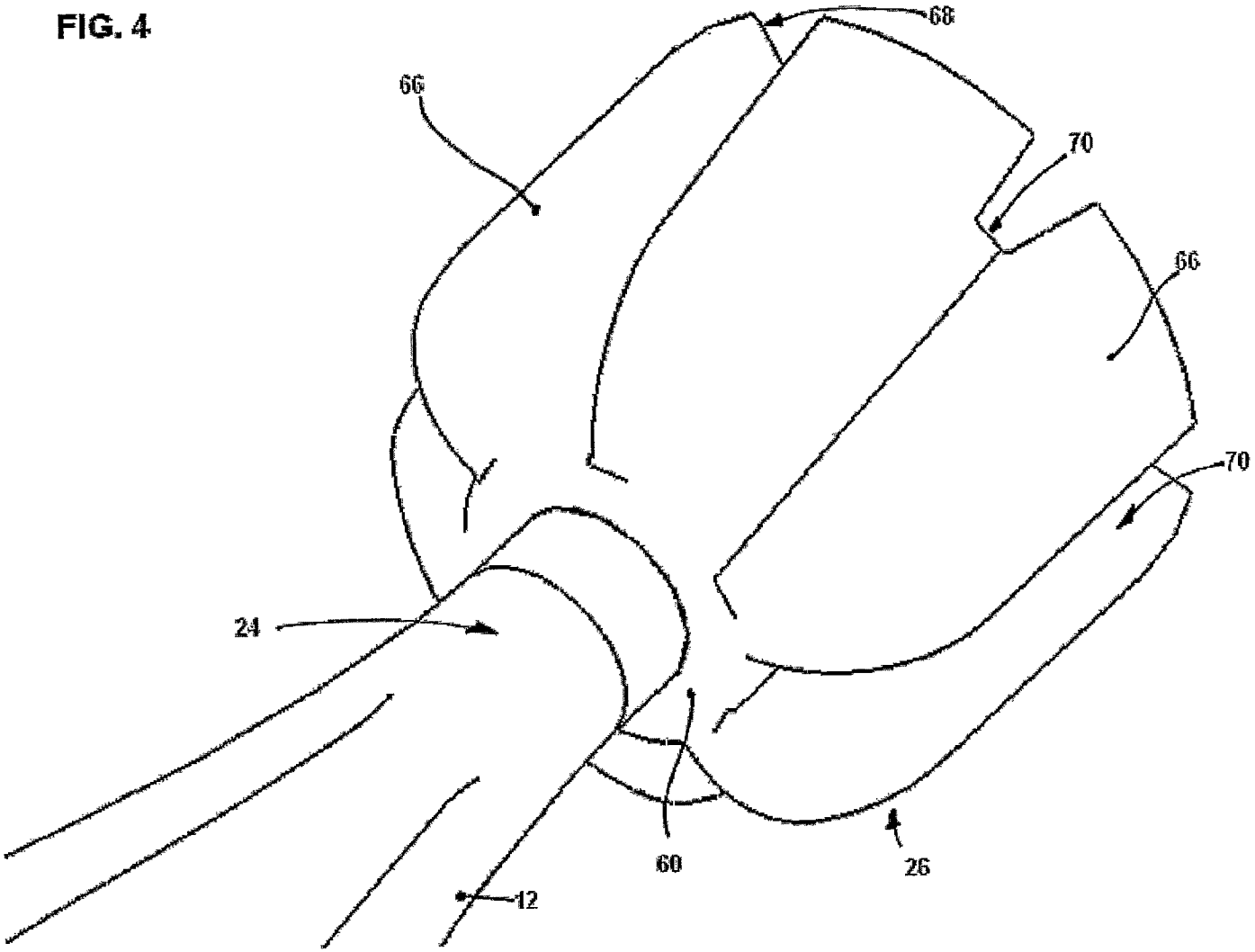
FIG. 4 shows a detail (in perspective) of a tail of the apparatus of FIG. 1.
Figure 5:
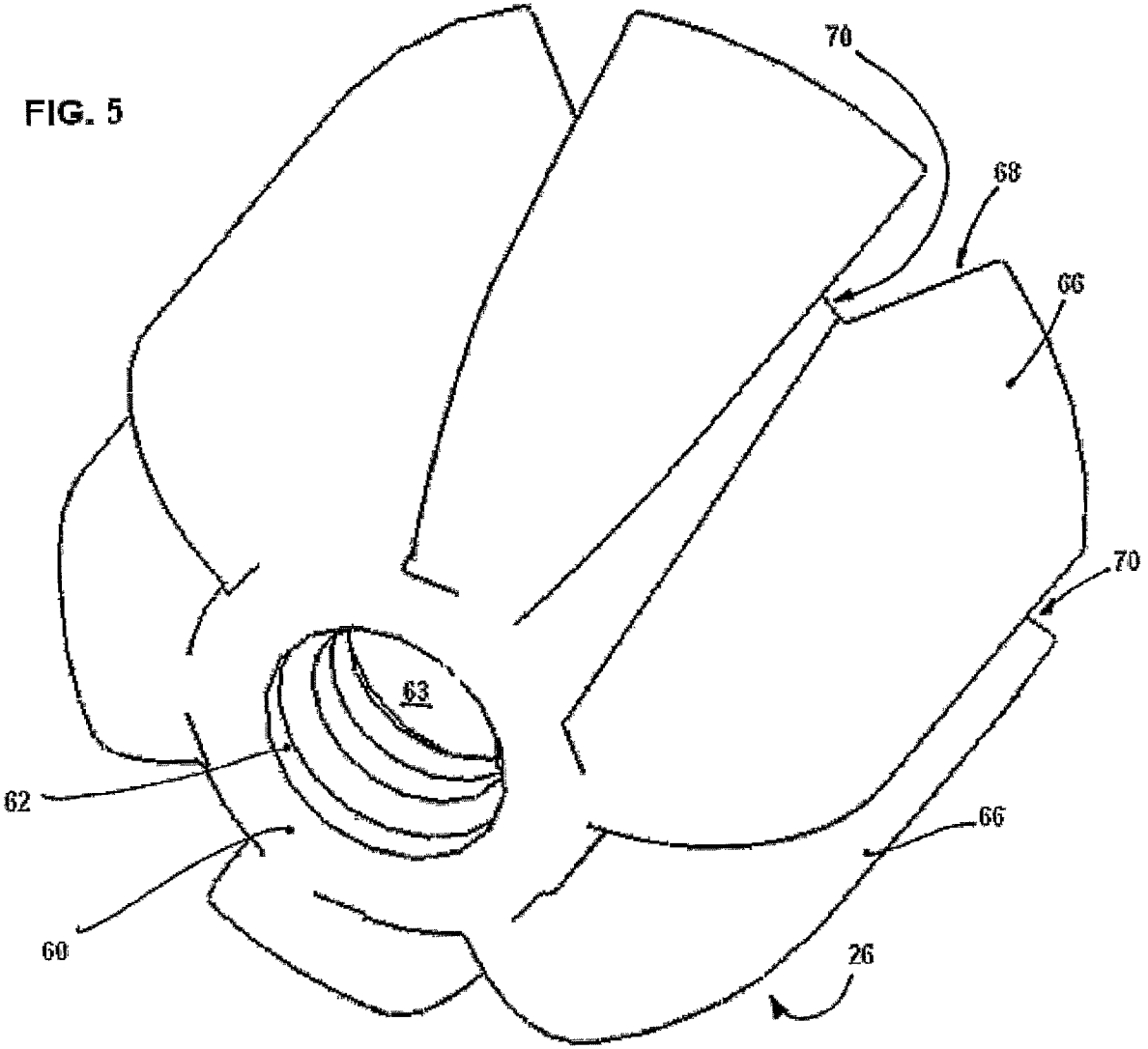
FIG. 5 shows (in perspective) the separated tail portion of the apparatus of FIG. 1.

Referring particularly to FIGS. 4 and 5, the spin-inducing tail cap 26 will now be described in greater detail. The cap causes the bomb to spin (rotate) about its longitudinal axis as it falls through the atmosphere (i.e. when in free-stream). This spinning can enhance the capacity of the bomb to be directed towards a target (e.g. a fire front, crop etc) and can also ensure that the bomb impacts a surface at its nose.

Figure 1:
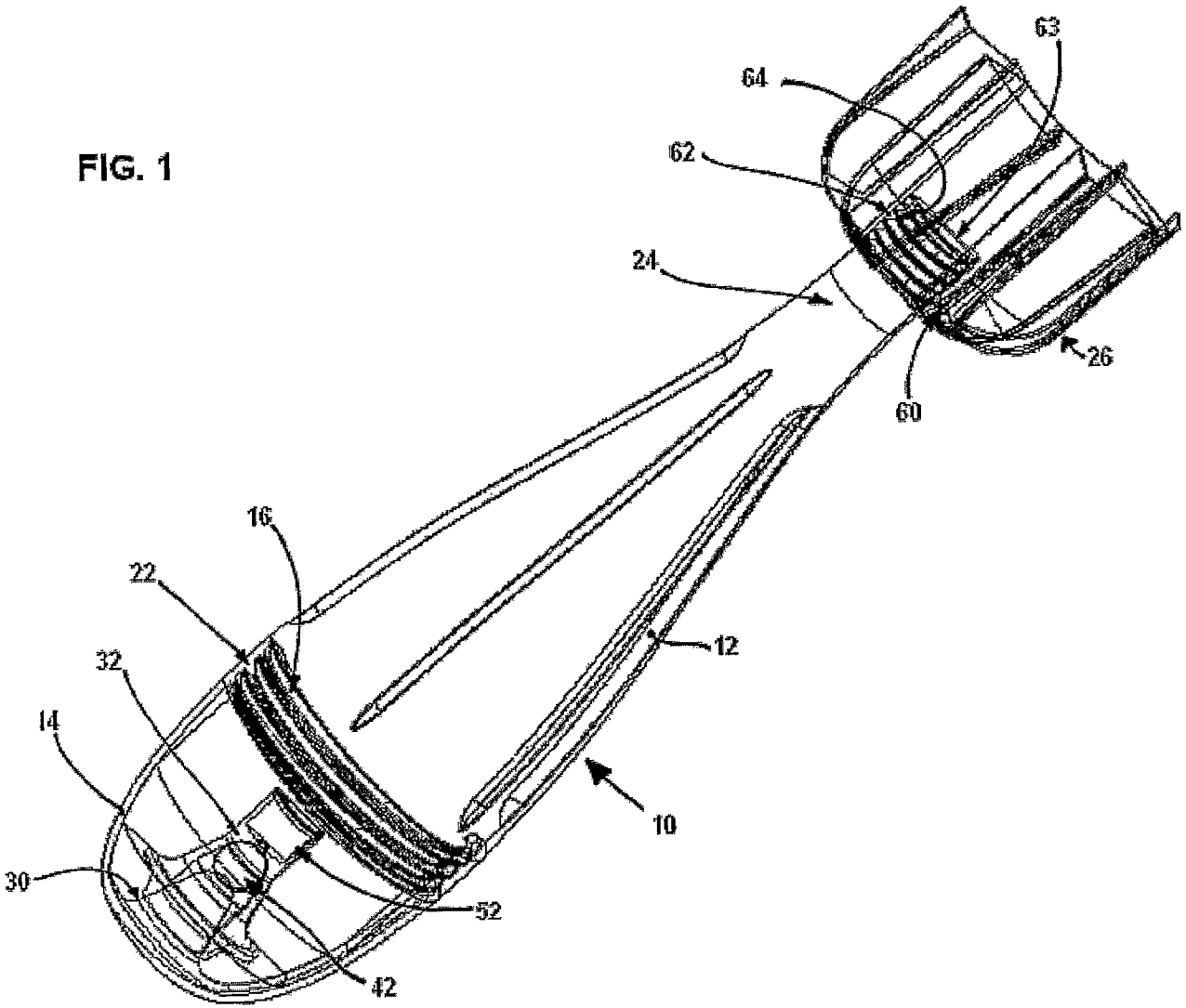
FIG. 1 shows a schematic cross-section (in perspective) through a fluid releasing apparatus according to a first embodiment.

In this regard, the cap 26 is screw mounted to the tail end 24 of the first casing portion 12. The cap 26 has a relatively narrow forward end 60 having an internally threaded central sleeve 62 that is screw mountable to an external thread 64 on the tail end 24 (FIG. 1). After filling the first casing portion with fluid through the tail end 24, a base 63 of the sleeve closes (i.e. seals) the tail end 24. The base 63 is typically of a water impermeable plastic.

A series of fin-like structures 66 extend out and back from the forward end to a wider trailing end 68 of the cap. The fin structures 66 define a series of recessed passageways 70 in an external part of the cap, moving from its forward to trailing ends, and through each of which air flows as the bomb falls through the atmosphere. In relation to the bomb's longitudinal axis, each passageway 70 is curved moving from the device's forward to trailing ends so as to induce the bomb spinning about its longitudinal axis.

The overall shape of the tail cap 26 also renders it less likely to snare branches, twigs and foliage etc on the way through e.g. a tree canopy. This is because the cap's volume is generally closed to such intrusions by the downward-facing surfaces of the fin structures 66.

The rupture lines/points in the first elongate casing portion 12 (as mentioned above) are typically designed so that the force or pressure required to cause them to fail is less than that required to force the tail cap 26 off its thread The bomb's component parts, such as the first and second casing portions 12, 14, as well as the tail cap 26, cartridge 32 and gas reservoir 42, can each be formed from a biodegradable polymer, or a polymer that has been adapted to biodegrade. This enables the bomb to be used in the open environment (e.g. in the fighting of bushfires) without itself representing a pollutant. Typically all components of the bomb are adapted to biodegrade.

The polymer can additionally comprise a component that is reflective to infrared radiation. This component can prevent melting of the polymer during immersion in or whilst in proximity to flame. Such flame may be generated by the explosion and/or may be present in the local environ in which the bomb is used (e.g. during a bushfire). The component can thus preserve the plastic during deployment and during subsequent biodegradation or clean-up.

The fluid can be a liquid, a flowable solid (such as a powder or slurry), an atomizable solid etc. The fluid can be employed in extinguishing fires, or can be another chemical for release such as a herbicide, defoliant, pesticide, insecticide etc.

The polymer can comprise a polyolefin such as polyethylene or polypropylene, and the additive that promotes biodegradation can be in the form of a filler such as an inorganic carbonate, a synthetic carbonate, nepheline syenite, talc, magnesium hydroxide, aluminium trihydrate, diatomaceous earth, mica, natural or synthetic silicas and calcined clays or mixtures thereof. The additive may also be a metal carboxylate, inclusive of a large number of metals, such as cerium, cobalt, iron, and magnesium, an aliphatic poly hydroxy-carboxyl acid and/or calcium oxide.

Insofar as IR reflection is concerned, the important spectral ranges for fire control are typically about 1 to about 8 μm or, for cool smoky fires, about 2 μm to about 16 μm. The component added to the polymer can thus desirably reflect adverse electromagnetic energy in such ranges and thus slow or retard the spread of fire.

The IR component can be a metallic or polymeric coating, layer or film applied to a main polymer that is reflective to infrared radiation. Such a coating, layer or film may comprise zinc or aluminium, a coating incorporating or comprising a metal phthalocyanine such as copper phthalocyanine etc. The component may alternatively be a dye or pigment introduced into the polymer that is reflective to infrared radiation. A specific such dye is copper phthalocyanine. Specific IR reflective pigments include titanium dioxide (rutile) and red iron oxide pigments with diameters of about 1 μm to about 2 μm, and thin leafing aluminium flake pigments.

A fire retardant paint or polymer additive can also be employed that reflects the thermal IR radiation emitted by fire in the 1 to 20 micrometer (μm) wavelength range. Usually the emissivity that results from the use of the component is less than or equal to 0.15.

The explosive device can comprise a low-explosive material, that is also of a nature to biodegrade, and that can be neutralised by contact with water. Examples of low-explosive materials include black powder, smokeless powder, etc.

The bomb typically has a length to diameter aspect ratio when fully assembled of 4/1 or greater. This optimises its targeting/trajectory.

The bomb is typically sized to hold a liquid fluid in the 10-30 L range. The bomb's total weight typically does not exceed 30 kg as, above this, the vessel must be handled mechanically or by two individuals.

Once the bomb 10 has been assembled as shown, and filled with a fluid to be dispersed, it is dropped from an aerial platform (plane, helicopter etc), hovering or in forward flight, in such a way as to strike the ground amidst a fire, narcotic base-crop plantation or similar target.

The bomb initially falls with its longitudinal axis approximately parallel with the earth's surface, before assuming a nose down attitude as it falls.

The relative velocity of the free-stream air acts on the tail cap causing the bomb to spin about its longitudinal axis, thus producing a directionally stabilizing effect. If contact with foliage, tree canopy, etc, occurs the nose-cone protects the vessel from damage, and the bomb penetrates any tree or foliage cover and strikes the ground in a nose down attitude.

At this point the reaction force resulting from the impact forces the piston against the ring-like flared end inner surface, producing a high hoop strain and causing the flared end to rupture. This allows the piston free end to deform (compress) the gas reservoir in the cartridge, and cause a compression of the gas (e.g. air) within the reservoir. The gas is forced into the capillary conduit in the first explosive material, and is adiabatically heated to a temperature sufficient to ignite the material (detonation).

The energy released causes a subsequent deflagration of the second explosive material (propellant charge). The deflagration of this charge material produces a pressure that is transmitted to the closed end of the first casing, which in turn causes the casing to compress, and to rupture vertically. Further, as the vessel is compressed, the fluid is displaced through the ruptures and is projected into the target area in a semi-hemispherical pattern.

Where the fluid is water, a defoliant, a herbicide or a fire retardant, it is atomized by the combination of impact and the deflagration of the dispersal charge. In the event that the target is a fire, and the fluid dispersed is water or a water/fire retardant mix, the atomization of the fluid will cause the evaporation of the contents, thereby removing a considerable amount of energy from the fire. This energy absorption is expected to be in the order of 200,000 kW for 10 kg of water released by the bomb.

Whilst a number of embodiments of the apparatus have been described, it will be appreciated that the apparatus can be embodied in many other forms.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments.

The invention claimed is:

1. An apparatus for releasing a fluid to the atmosphere, the apparatus comprising:

a housing unit for the fluid, the housing unit having an outer surface for impacting at a surface and an inside surface located inwardly relative to the outer surface, the housing unit comprising an integral piston extending inwardly from the inside surface of the housing unit at a location adjacent to a position where the housing unit is adapted to impact at the outer surface, and such that the piston does not extend outwardly beyond the housing inner surface at that position;

a mechanism for causing rupture of the housing unit whereby the fluid is released to the atmosphere from the housing unit, the mechanism comprising an explosive charge located within the housing unit, the explosive charge arranged to effect the rupturing of the housing unit when detonated; and a gas cavity located within the housing unit between the explosive charge and the piston; wherein the gas cavity encloses a gas that is able to be pressurized by an inwards movement of the piston caused by the housing unit impacting at the outer surface whereby, when the gas is pressurized by such inwards movement of the piston, it increases to a temperature sufficient to cause detonation of the explosive charge.

2. An apparatus as claimed in claim 1 wherein the mechanism comprises an explosive device positioned within the apparatus whereby, at surface impact, the piston moves towards the explosive device to cause it to detonate and thus explode, whereby the resultant explosion causes the housing unit to rupture and release the fluid.

3. An apparatus as claimed in claim 2 wherein-the housing unit is elongate and comprises a nose and an opposing tail, with the piston extending inwardly from the nose, with an explosive charge being positioned adjacent to a free end of the piston.

4. An apparatus as claimed in claim 1 wherein the explosive charge comprises a first explosive material detonable by the pressurized gas, and a second explosive material that is adjacent to, or surrounds the first explosive material and that is adapted to deflagrate when the first explosive material detonates or deflagrates.

5. An apparatus as claimed in claim 1 wherein the housing unit comprises a biodegradable polymer, or a polymer that has been adapted to biodegrade.

6. An apparatus as claimed in claim 1 wherein the housing unit comprises a polymer that in turn comprises a component that is reflective to infrared radiation so as to prevent melting of the housing polymer during immersion in or whilst in proximity to flame.

7. An apparatus as claimed in claim 1 wherein the mechanism for causing the fluid to be released to the atmosphere from the housing unit is further adapted to cause the fluid to atomize at release.

8. An apparatus as claimed in claim 7 wherein the mechanism is adapted to cause an explosion internally of the apparatus that in turn causes housing rupture and fluid atomization at release.

9. An apparatus as claimed in claim 1 wherein the housing unit comprises rupture lines or points that are located to provide a pre-weakened structure to the housing, thus facilitating mechanism release of fluid to the atmosphere.

10. An apparatus as claimed in claim 9 that further comprises a device that can be mounted to the tail to close a fluid opening to the housing unit, and wherein the rupture lines/points in the housing are adapted such that a force/pressure required to cause them to fail is less than that required to force the device off its mounting to the tail.

11. An apparatus as claimed in claim 1 that has the form of a bomb.

12. An apparatus as claimed in claim 1, wherein the housing unit comprises a first housing for the fluid and a second housing detachably mountable to the first housing, the second housing being adapted for causing the fluid to be released to the atmosphere from the housing unit.

13. An apparatus as claimed in claim 12, wherein the piston extends inwardly and within the confines of the second housing, the piston being caused to move inwardly to rupture the first housing when the second housing impacts a surface.

14. An apparatus as claimed in claim 12, wherein the first housing for the fluid is elongate, with one end of the first housing comprising a generally flat portion so as to enable the first housing to separately stand on a surface.

15. An apparatus as claimed in claim 14, wherein an opposing end of the first housing is openable to enable the fluid to be introduced therein.

16. An apparatus as claimed in claim 1 further comprising a restraint mechanism adapted for regulating when the fluid is to be released from the housing unit to the atmosphere, whereby the restraint mechanism is deactivated once a certain force of apparatus impact with a surface has been reached.

17. An apparatus as claimed in claim 16, wherein the restraint mechanism further comprises a member for restricting inwards movement of the piston until the certain force of apparatus impact with the surface is reached.

18. An apparatus as claimed in claim 17, wherein the piston is adapted at surface impact to be urged inwardly towards an explosive charge positioned within the apparatus to detonate the same, whereby the resultant explosion causing the housing unit to rupture and release the fluid, and wherein the member is ring-like to surround the piston and only to allow its passage therethrough and towards the explosive charge when the apparatus impact with the surface produces the certain force.

19. An apparatus as claimed in claim 18, wherein movement of the piston through the member at the certain force is enabled by the member deforming or breaking.

20. An apparatus as claimed in claim 1, wherein the housing unit is elongate and has a longitudinal axis, the housing unit being adapted to spin about the longitudinal axis as it falls through the atmosphere.

21. An apparatus as claimed in claim 20, wherein the housing unit comprises a nose and an opposing tail, with the adaptation of the housing unit comprising a device that is associated with the tail to induce the spinning about the housing unit's longitudinal axis.

22. An apparatus as claimed in claim 21, wherein the device comprises an end cap having a narrower forward and mountable to the tail, and a wider trailing end, the device further comprising one or more recessed passageways in its outer surface moving from its forward to trailing ends, and through each of which air flows as the housing unit falls through the atmosphere so as to include the spinning about the housing unit's longitudinal axis.

23. An apparatus as claimed in claim 22, wherein in relation to the longitudinal axis, the one or more passageways each have a curve moving from the device's forward to trailing ends so as to induce the spinning.

24. An apparatus as claimed in claim 21, wherein the housing unit's centre of gravity lies towards the nose, relative to the tail, such that the apparatus falls through the atmosphere nose first.

25. An apparatus as claimed in claim 1, further comprising a restraint mechanism for preventing inadvertent fluid release from the housing unit to the atmosphere, wherein the restraint mechanism interacts with the piston whereby the restraint mechanism is deactivated once a certain force of apparatus impact with a surface has been reached.

26. An apparatus for releasing a fluid to the atmosphere according to claim 1, the apparatus further comprising a restraint mechanism arranged to restrain the inward movement of the piston to prevent inadvertent fluid release from the bomb, the restraint mechanism comprising a first tapered surface that is adapted to surround the piston and interact with a second tapered surface of the piston, wherein the first tapered surface and the second tapered surface taper in mutually opposing directions, thereby preventing the inward movement of the piston.

* * * * *